US005522333A

United States Patent [19]

Lang et al.

[11] Patent Number: 5,522,333

[45] Date of Patent: Jun. 4, 1996

[54] CATAMARAN BOAT WITH PLANING PONTOONS

[75] Inventors: Thomas G. Lang, 417 Loma Larga Dr., Solana Beach, Calif. 92075-1719; James T. Lang, San Diego, Calif.

[73] Assignee: Thomas G. Lang, Solana Beach, Calif.

[21] Appl. No.: 243,388

[22] Filed: May 16, 1994

[51] Int. Cl.[6] ..... B63B 1/00

[52] U.S. Cl. ..... 114/61; 114/274; 114/292

[58] Field of Search ..... 114/61, 123, 274, 114/275, 276, 277, 278, 279, 283, 288, 289, 292, 291, 83

[56] References Cited

U.S. PATENT DOCUMENTS

| | | | |
|---|---|---|---|
| 3,470,839 | 10/1969 | Faul et al. | 114/61 |
| 4,043,285 | 8/1977 | Nordstrom | 114/83 |
| 4,091,761 | 5/1978 | Fehn | 114/61 |
| 4,174,671 | 11/1979 | Seidl | 114/61 |
| 4,516,518 | 5/1985 | Cate | 114/61 |
| 4,748,929 | 6/1988 | Payne | 114/61 |
| 4,802,428 | 2/1989 | Lang | 114/61 |
| 4,813,366 | 3/1989 | Elder | 114/61 |
| 5,188,049 | 2/1993 | Graf | 114/61 |
| 5,282,763 | 2/1994 | Dixon | 114/61 |

FOREIGN PATENT DOCUMENTS

| | | |
|---|---|---|
| 2003154 | 11/1969 | France . |
| 55565 | 6/1967 | Germany . |
| 1260831 | 1/1972 | United Kingdom . |

*Primary Examiner*—Stephen Avila
*Attorney, Agent, or Firm*—William W. Haefliger

[57] ABSTRACT

In a catamaran boat, including a propulsion system, and main hull positioned to travel above the water surface, the hull extending longitudinally forwardly, the combination comprising: two pontoons, each spaced below the main hull, the pontoons extending forwardly; support means carried by the main hull and carrying the pontoons, whereby the pontoons are at least mostly submerged below the water surface when the boat is loaded and at rest; the pontoons having associated chines positioned to permit the pontoons to plane on the water surface at typical planing speeds of the boat; the support means having streamlined leading edge structure and upper sponson structure; and the support means having lateral thickness at a longitudinal location spaced at a level above the pontoons and which is less than the maximum width of each of the pontoons at the longitudinal location.

59 Claims, 5 Drawing Sheets

FIG. 10.
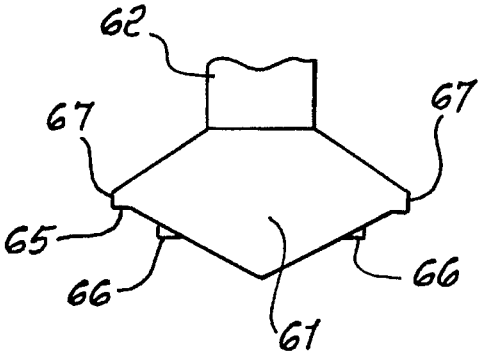
FIG. 11.
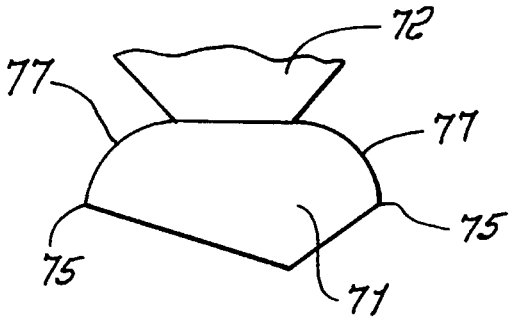
FIG. 12.
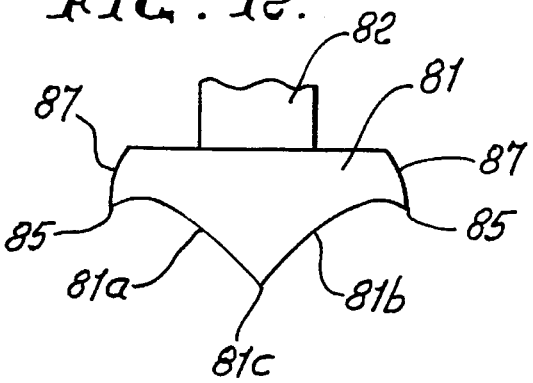
FIG. 13.
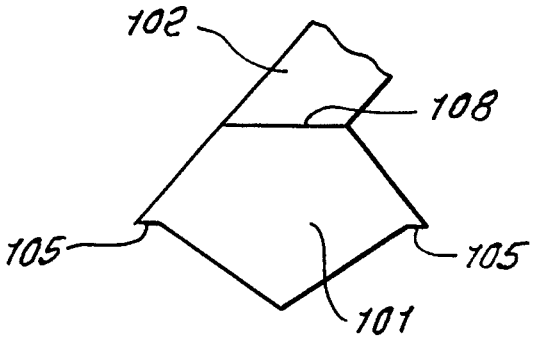
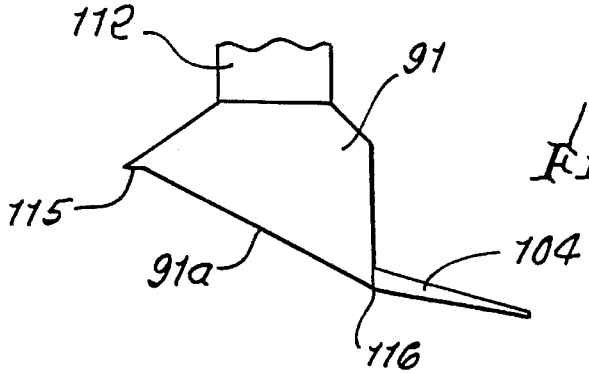
FIG. 14.

CATAMARAN BOAT WITH PLANING PONTOONS

BACKGROUND OF THE INVENTION

This invention relates generally to catamaran type boats, and more particularly to improvements in the structure or structures that support the main hulls of such boats on pontoons.

In a catamaran boat, the main hull is normally positioned above the water surface, and carries a support means for carrying the pontoons. The main hull provides accommodation for passengers, and is located above the water surface to minimize motion and spray due to the action of waves. In this regard, the primary goal of a PLANING SWATH boat, which is the generic name for this new concept, is to minimize motion at both pre-planing and at planing speeds. Motion is reduced by two laterally-spaced pontoons which are mounted below a main hull by support means. The pontoons are at least mostly submerged at pre-planing speeds, and rise to plane on the water surface at higher speeds.

"SWATH" is an acronym for "Small Waterplane Area Twin Hull" which stems from its use for a displacement-type of ship known as a SWATH ship. A PLANING SWATH is similar to a SWATH ship, except that its pontoons are designed to plane on the water surface instead of always remaining submerged. This distinction permits a PLANING SWATH to reach much higher speeds than a SWATH ship.

The main hull structurally ties together the two laterally-spaced pontoons and their associated support means. At rest, and at pre-planing speeds, waves can produce large side loads on the pontoons and their support means. These side loads produce large transverse bending moments on the main hull. Consequently, the main hull must have structural means for handling these bending moments. Typical means consist of lateral frames, bulkheads, or box beams.

Other large loads applied to the main hull are upward forces produced by waves impacting the pontoons and support means. These loads can be highly asymmetrical, thereby producing large torsional forces on the main hull, for example certain wave conditions that try to trim one pontoon upward while trying to trim the other pontoon downward.

The lower deck of the main hull is exposed to downward loads from people and equipment, and upward loads from wave impacts.

SUMMARY OF THE INVENTION

It is a major object of the invention to provide improvements in a catamaran boat that includes a propulsion system and a main hull positioned to travel above the water surface, the hull extending longitudinally forwardly. In this environment the invention provides, in combination:

a) two pontoons, each spaced below said main hull, said pontoons extending forwardly, b) support means carried by the main hull and carrying said pontoons, whereby said pontoons are at least mostly submerged below the water surface when said boat is loaded and at rest, c) said pontoons having associated chines positioned to permit the pontoons to plane on the water surface at typical planing speeds of the boat, d) said support means having streamlined leading edge structure and upper sponson structure, e) said support means having lateral thickness at a longitudinal location spaced at a level above said pontoons and which is less than the maximum width of each of said pontoons at said longitudinal location.

As will be seen, the pontoons are preferably symmetrical about their vertical center planes and identical; however, the pontoons may have assymetrical planing surfaces.

Another object is to provide pontoons having removable connections to the support structure. As will be seen, each pontoon typically has at least one strake; and the pontoons have aft ends that preferably taper toward near-zero width.

Yet another object is to provide chines defining planing surfaces, each chine typically laterally inclined to the horizontal within a range of fifteen degrees, each pontoon sometimes having at least one step on its said planing surface. Further, each pontoon typically has a stern and a step located near the stern.

An additional object is to provide pontoons having upper surfaces that are inclined downward from a longitudinal center line at center locations. Such upper surfaces typically have inverted V-shaped cross sections at certain locations; and such upper surfaces may curve downward at other locations. Also, each pontoon may have a vertical region of near-constant width.

Another object is to provide main hull support means that includes two laterally spaced supports each of which includes at least one attachment region to the associated pontoon. Each such support has a sponson portion, and may include a strut portion. Also, each support may have at least one strake. The support typically has a leading edge that fairs continuously downward and rearward into the leading edge and keel of its associated pontoon, and the support typically has a boat tailed configuration. In addition, part of the structure of the main hull may include at least one longitudinal stiffener which extends at least partly below the lower surface of the main hull between the supports.

A further object includes the provision of a propulsion system that includes at least one propulsor. The boat has cross structure above said pontoons and said propulsion system includes an engine at least partially located in one of the following:

i) the cross structure ii) within a sponson iii) within a pontoon.

Also, at least one lifting hydrofoil may be attached to at least one of the following:

i) said main hull.

ii) said supports iii) said pontoons.

Further, a hydrofoil may be attached to the boat or propulsor to provide pitch stability or pitch control.

An additional object includes provision of chines that define planing surfaces, and said planing surfaces typically having a deep-vee configuration along at least most of their length. Those planing surfaces may be angled upward in pitch a few degrees relative to the at-rest water line, and may also be warped whereby the deadrise reduces toward the stern.

Yet another object typically includes the provision of at least one transverse box beam of arbitrary shape located within said main hull to help counteract torsion moments and bending moments.

These and other objects and advantages of the invention, as well as the details of an illustrative embodiment, will be more fully understood from the following specification and drawings, in which:

DRAWING DESCRIPTION

FIGS. 9–13 are enlarged vertical sections taken transversely through modified pontoon and chine structures; and FIG. 14 is view like FIG. 9, but showing assymetric structure, and use of a hydrofoil.

DETAILED DESCRIPTION

Figure 1:
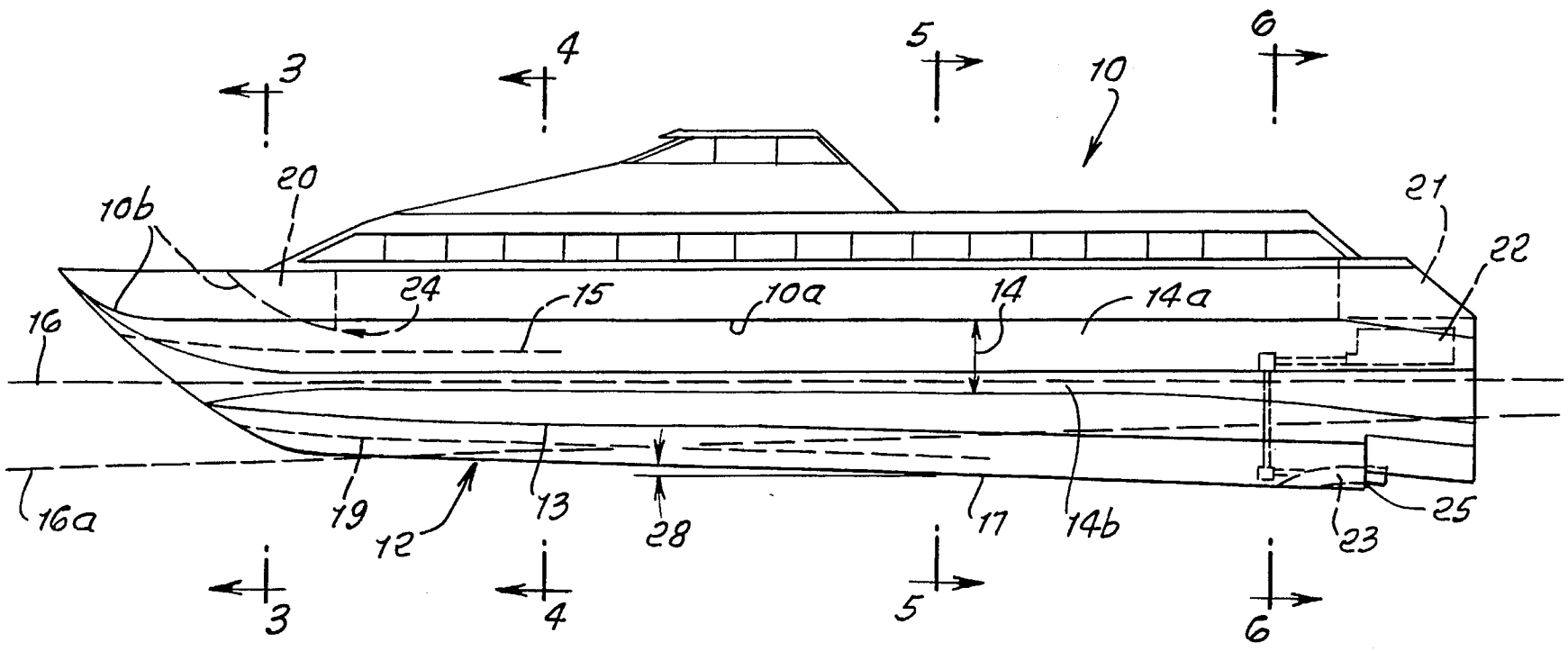
FIG. 1 is a side elevation showing a catamaran boat embodying the invention.
Figure 2:
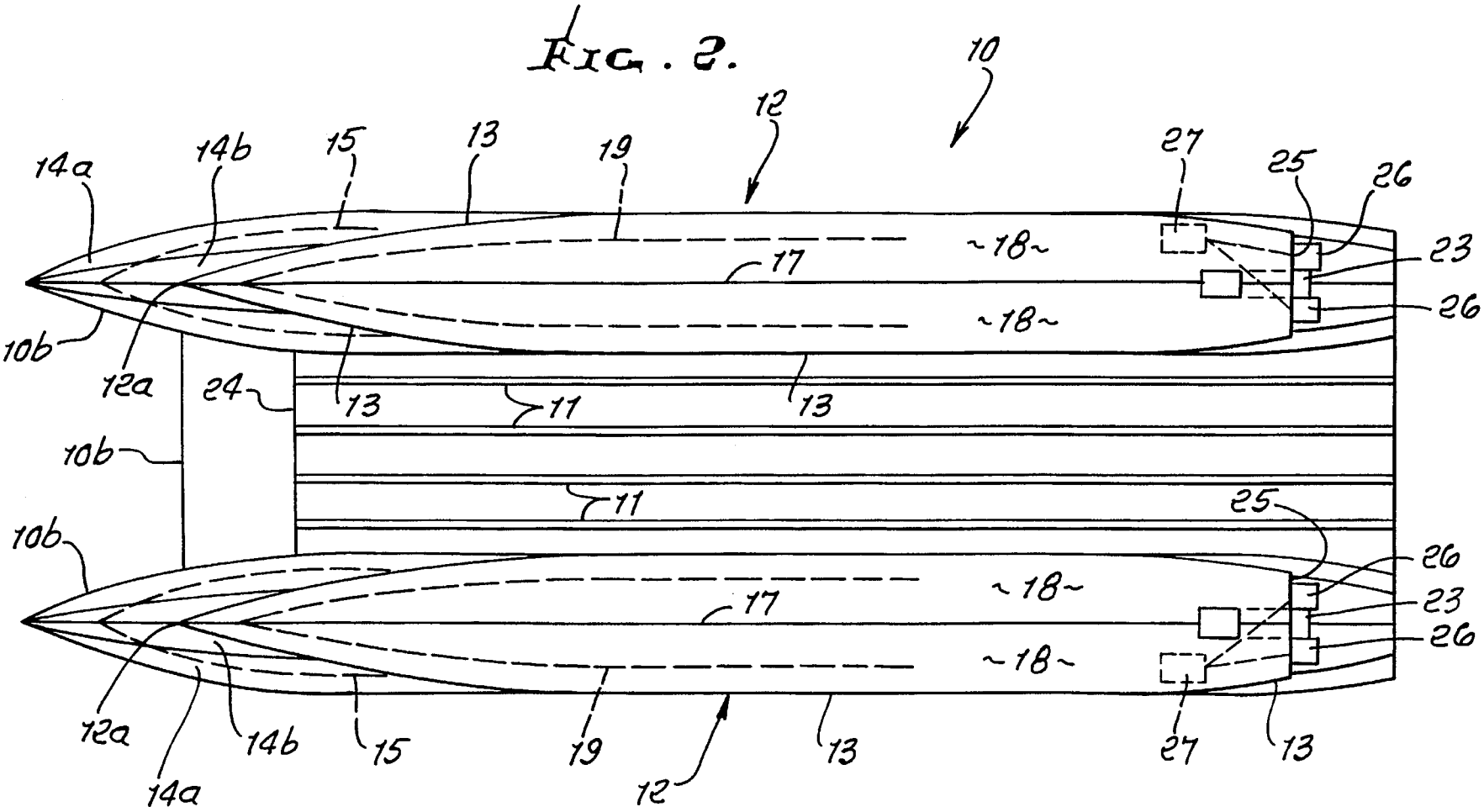
FIG. 2 is a bottom plan view of the FIG. 1 boat.
Figure 5:
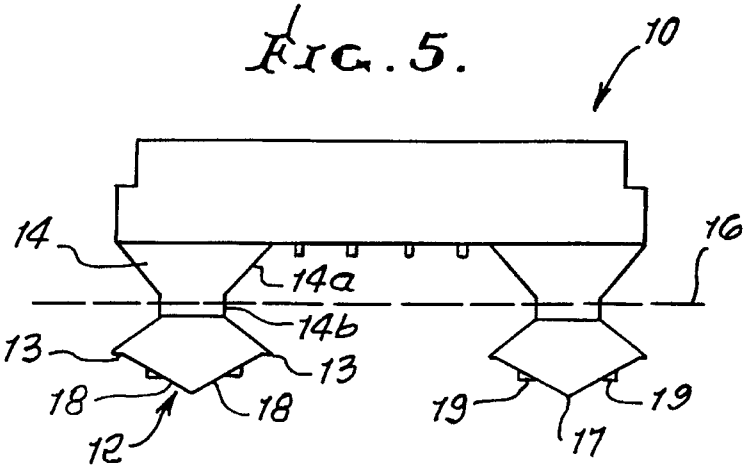
FIGS. 3–6 are sections taken on lines 3—3, 4—4, 5—5, and 6—6 of FIG. 1, showing outlines of the structures.
Figure 6:
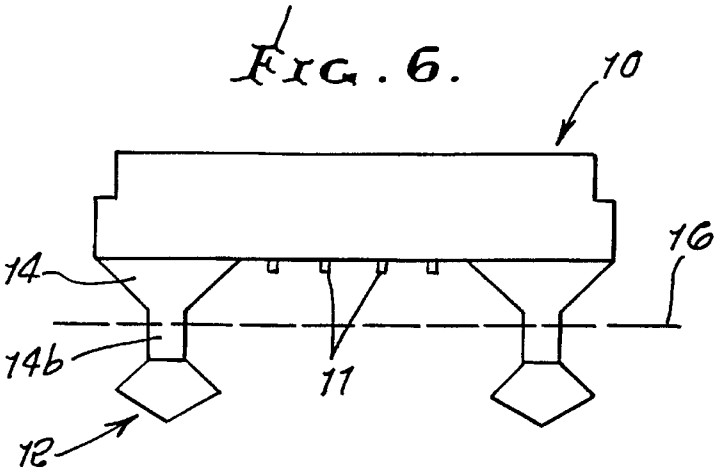
Figure 3:
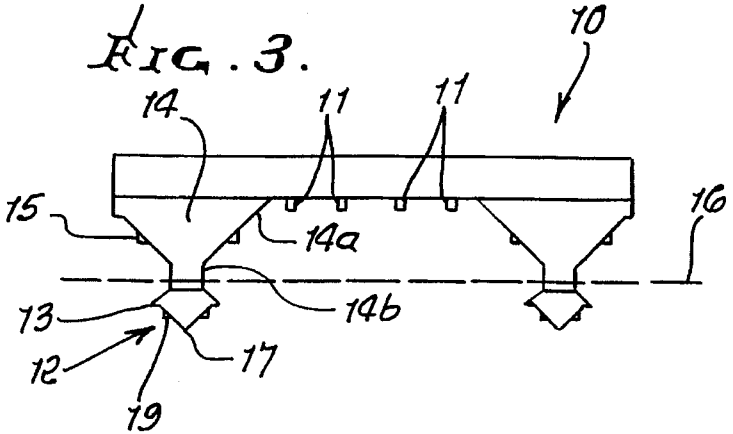
Figure 4:
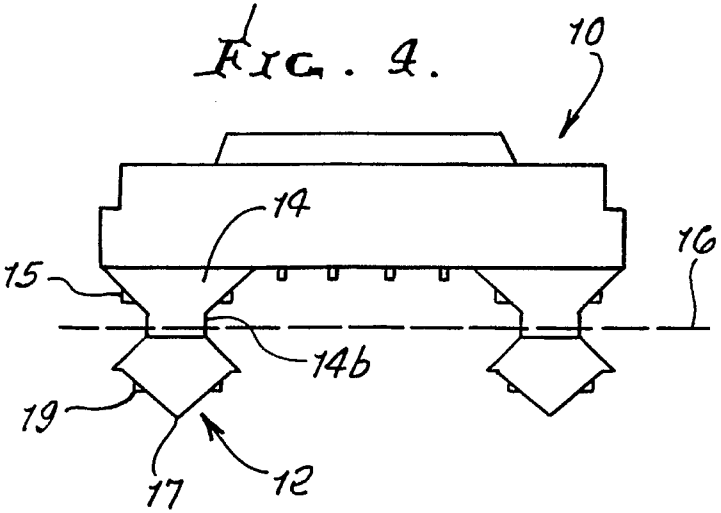

As seen in FIGS. 1–6, elements of the catamaran are seen, as follows:

10—main upper hull

10*a*—bottom of main hull

10*b*—bow of main hull

11—stiffeners under main hull

12—pontoons (alike)

12—leading edges of 12

13—chines on pontoons

14—supports

14*a*—sponsons (upwardly divergent upper portions of supports)

14*b*—struts (near-constant-thickness lower portions of supports)

15—strakes on supports

16—typical water surface level, (pre-planing)

16*a*—water surface level during planing

17—pontoon keel

18—pontoon planing surfaces, upwardly divergent

19—strakes on surface 18

20—lateral box beam (forward)

21—lateral box beam (rear)

22—engine for driving water jet unit

23—water jet unit

24—upper hull bow step

25—pontoon step

26—adjustable trim plates on aft ends of pontoons, to control planing

27—drives to control angularities of trim plates

28—pitch angle of pontoon keel relative to at-rest water surface

The bow 10*b* of the main hull 10 is designed to reduce the effect of wave impacts. One or more bow projections (shaped somewhat like the bow section of a monohull boat) may be added to the underside of the bow between the support means to reduce wave impacts. Also, the lower surface of the bow typically has a transverse step 24 located in a region where the lower surface becomes inclined downward around five to ten degrees. This step makes the water separate from the underside surface during wave impacts, thereby providing upward lift to raise the bow over the wave.

Each individual support means 14 typically has horizontal cross sections that include a streamlined leading edge region, and either a blunt trailing edge region, or a streamlined trailing edge region that may either be fairly sharp or cut-off, the latter being called a "boat tail". Compare FIGS. 3–6. Although the central region of a horizontal cross section of a support means may be curved convexly, it more often has a constant thickness. Each support means has a vertical region which tapers distinctly outward toward its upper end; this "sponson" region 14*a* will be described more fully in the next below.

The support means typically consists of two supports 14 spaced laterally so that each carries one pontoon 12. Each such laterally-spaced support preferably consists of one individual support, although it may consist of, or include, two or more individual supports. The support 14 extends throughout the major length of its associated pontoon, as shown. The lateral thickness of the support, at some longitudinal location, should be less than the maximum width of the associated pontoon at that location, and preferably is less at all longitudinal locations. The support should have a sufficiently large horizontal cross section at the various possible operating water levels, including water level changes due to waves and motion, so that it provides the boat with static stability in both pitch and roll. Methods for calculating static stability are well known, and are readily available. By static stability is meant the ability of the boat, when at rest, to return to a normal trim or heel angle, after being deflected. For example, if the boat is heavily loaded to the point where the waterline lies above the pontoons, and in the region of the support means, the boat could heel or trim to an undesired angle if the support means was too small to provide static stability at that waterline. The support may extend vertically, upward, or be inclined to the vertical. Each support typically has one or more strakes 15 on each side to reduce spray. Independent of its inclination, a support means may have a region, called a strut 14*b*, of near-constant lateral dimension, located above its attachment to the associated pontoon. Alternatively, the lateral dimension of the support can vary vertically such that its minimum thickness lies either near its attachment to a pontoon, or some distance above this attachment.

A preferred support shape is one which includes a leading edge that angles downward, and rearward, from the bow region of the boat, and merges smoothly into the leading edge and keel region of its associated pontoon. A sponson, as at 14*a*, is defined as the upper region of a support means, as at 14, which flairs distinctly outward in thickness. Sponsons serve two main functions. One main function is to provide buoyancy in waves in order to raise the main hull so that waves will not impact the main hull as often, and to also raise the bow in case the boat attempts to plunge into a wave. The other main function of the sponsons is to structurally spread the applied loads over a larger portion of the main hull. Another function is to provide space for reception or storage of boat equipment, engines, generators, fuel, fresh water and the like.

Structurally, the sponsons are typically designed to carry a number of loads, including vertical loads, side loads, bending moments and torsional moments. The skins of the sponsons form longitudinal box beams that help to carry these loads into the main hull. Internal lateral bulkheads or frames may typically be used to further help carry vertical and side loads. The pontoons, as at 12, serve four main functions. At pre-planing speeds, including the at-rest condition, the pontoons provide the bulk of the buoyancy required to support the main hull 10, and most or all of the support means 14 above water. Another main function is to damp motion at pre-planing speeds because they are mostly (or fully) submerged, and thereby tend to resist motion, especially if their chines are submerged. The third primary function of the pontoons is to provide the surface area needed for planing over a range of planing speeds, and the fourth main function is to provide a shape which minimizes wave-induced forces and motions when planing.

Wave-induced forces during planing can be greatly reduced by limiting the beam width of the pontoons, and by using relatively large deadrise angles (i.e., lateral angle of a planing surface upward from the horizontal), commonly called deep-vee planing surfaces, as seen in FIGS. 3–6. Wave forces can be further reduced by designing the pontoons to pierce the tops of the larger waves. Reducing these wave-induced forces reduces boat motion, thereby increasing comfort and speed in waves, improving passenger safety, and reducing sea sickness.

Another consideration in the design of the pontoons is hydrodynamic efficiency. A large deadrise angle somewhat reduces planing efficiency. However, efficiency can be increased by incorporating strakes, as at 19, in the planing surface, and possibly by warping the planing surface to reduce the deadrise angles toward the stern. The keel line is normally kept straight near the stern, although it is sometimes beneficial to provide "rocker" i.e. curving the keel upward toward the stern, and occasionally even beneficial to include "hook" meaning to curve the keel downward toward the stern. The strakes are shown as lateral projections from surfaces 18, that extend lengthwise rearwardly, from forward portions of the pontoons.

At pre-planing speeds, the drag of the pontoons can be reduced by reducing their cross-sectional areas near the stern, as shown. The pontoon tail regions can be fully streamlined, but more typically are cut-off or "boat tailed".

A planing surface typically has chines along the side edges to force the water to separate from the planing surface rather than flow up around the sides and wet the region above the desired planing surface. A chine is an angular break between two adjacent surfaces, and may be somewhat rounded, but is more typically fairly sharp. If rounded, the radius must be small enough so that the water separates from the pontoon surface at the chine. To improve efficiency, and to reduce spray, the chines are typically angled laterally toward the horizontal, away from the deadrise angle of the planing surface, as seen at 13. However, chine angles may vary from extending vertically downward to being angled upward and flush with the planing surface at the deadrise angle. Chine angles are typically horizontal, or between zero and ten degrees down from the horizontal. The width of a chine is typically a small fraction of the transverse width of the adjacent planing surface.

The pontoons will typically have one or more strakes on each planing surface to minimize spray, and to increase efficiency. Also, to minimize spray when piercing waves, and to provide a smoother wave entry, the forwardmost tips of the pontoons are generally designed to lie below their uppermost parts, as seen in FIG. 1. The cross-sections of the pontoons can vary considerably. A relatively simple cross-section is diamond-shaped wherein the lower part, or planing surface, is vee shaped and contains chines; and the upper surface is an inverted vee shape which is cut off to provide a flat region for attachment to a support means. See FIGS. 3–6. Alternatively, each planing surface cross section could be convex or concave instead of flat. Also, the upper surfaces of the pontoons may be convex, or possibly even totally flat. The preferred upper surface shape is either an inverted vee or a convex curve. To increase buoyancy without increasing pontoon width, the upper and lower surfaces can be spaced apart by the addition of a near-constant-width mid section. This added mid section can significantly increase the cross-sectional area of a pontoon. Also, the cross-sectional size and shape can vary significantly over the length of a pontoon. Typically, the cross-sectional area is a maximum in the center region along the pontoon length, and reduces toward each end. The pontoons may also be inclined upward in pitch a few degrees relative to the at-rest water line (see 28 in FIG. 1); said incline reduces the pitch angle of the boat when planing because the pontoons are already closer to their planing pitch angle which lies around three to five degrees. Also, data from SWATH ship model tests indicates that drag with pontoons submerged is minimized when pitch is around two degrees.

Figure 9:
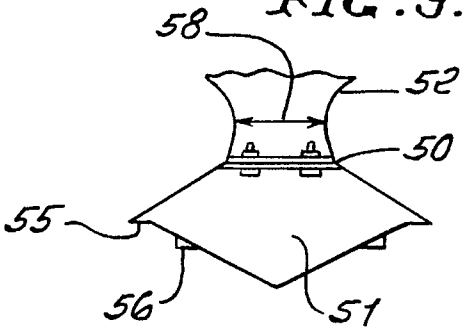

Catamarans generally do not bank sharply into turns like most monohull boats, nor do they turn as rapidly. One way to increase the turn rate and maneuverability of a PLANING SWATH boat is to design pontoons with only one planing surface such that the planing surface is angled upward and outward from an inboard keel; in this case, the inner side of each pontoon is typically close to vertical, and the keel acts as the inboard chine. On the other hand, a symmetrical planing surface permits each pontoon to be identical, interchangeable, less costly to manufacture, and provides a superior hydrodynamic shape at pre-planning speeds. The pontoons can be designed to be removable. See FIG. 9 showing removable attachment at 50 of a pontoon 51 to support 52. Being removable has the potential advantage of reducing cost, and permits replacement in case of damage or if pontoon size must be changed because of a change in boat carrying load. Also, to simplify construction, the pontoons can be foam-filled.

Figure 7:
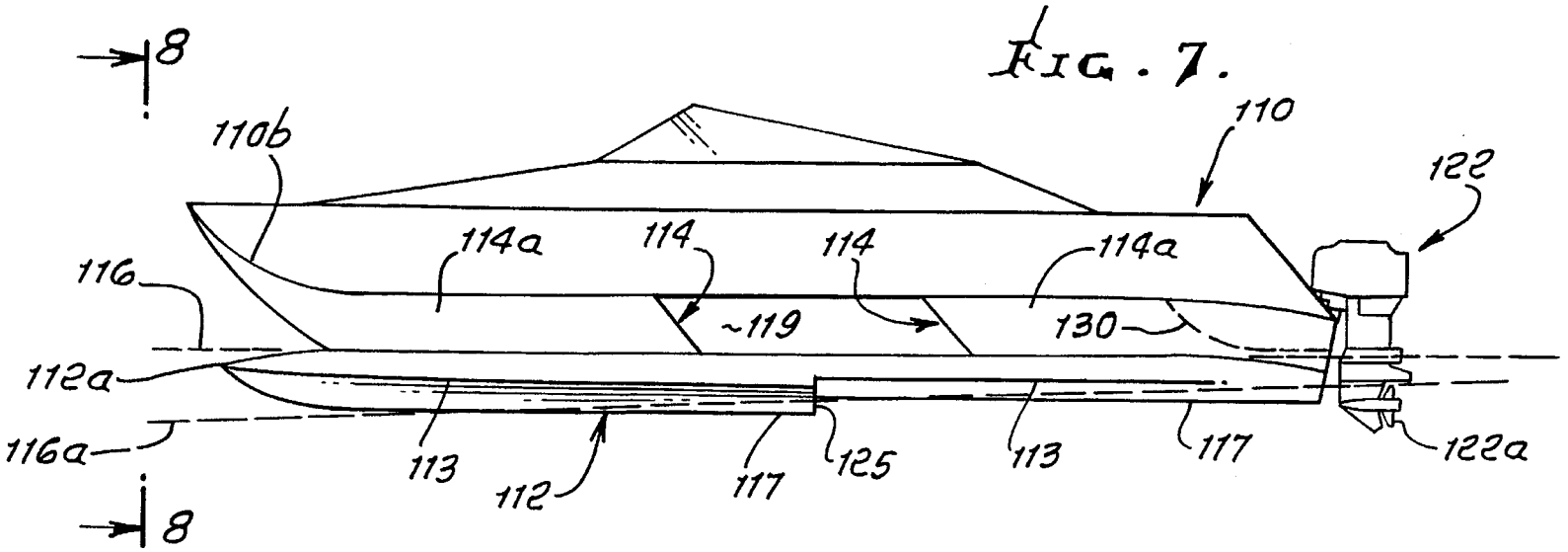
FIG. 7 is a view like FIG. 1, showing a modified catamaran boat embodying the invention.

It is sometimes desirable to place a step on each pontoon just ahead of its aft end. This step makes the water flow separate, serving to move the aft end of the planing surface ahead of the stern of the pontoon. The reasons for doing this include the ability to move the center of pressure of the planing surface forward in order to better match the boat's center of gravity, and to provide more buoyancy aft of the planing surface in order to raise the aft end of the boat at pre-planing speeds if the boat is tail heavy. A wide variety of propulsion systems may be provided. Either outboard or inboard engines can be used, and either gas engines, diesel engines or turbines can provide the power. FIG. 1 shows an inboard engine 22, and FIG. 7 shows use of an outboard engine 122, and propeller **122*a*. Either fully-wetted or surface-piercing propellers, or water jets (see 23**) can be used as propulsors. The engines can be placed in the upper hull, sponsons, pontoons, or combinations thereof. An alternative propulsion system comprises the use of one or more sails, either in addition to a power source or instead of one. In order to plane, such a sail boat would have to be relatively light in weight. When not planing, the performance is expected to be reasonably good when compared with other sail boats, if well designed.

The drag when planing can be reduced by generating part of the lift by means of one or more hydrofoils. A preferred geometry is to add a lifting hydrofoil to each pontoon near the boat's center of gravity. Alternatively, a pair of forward and aft lifting foils added to each pontoon, or spanning between pontoons, is also feasible. A different way to reduce drag is to add one or more steps to each planing surface. The drag can possibly be further reduced by pumping air into the space behind the steps. FIG. 14 shows a hydrofoil 104 attached to a pontoon 91.

At pre-planing speeds, drag can be reduced by tapering the aft ends of the pontoons by either tapering them almost to zero, or by cutting them off bluntly, called "boat tailing".

The trim of a PLANING SWATH boat may not need to be controlled. However, if needed, trim can be controlled by pivotally attaching an adjustable-angle plate 26, as in FIG. 2, flush at the aft end of one or more planing surfaces, as described above. Another means to control trim is to change the pitch angle of the propulsor. The effectiveness of the latter approach can be augmented by adding a horizontal hydrofoil to the propulsor. Still another means for controlling boat trim is to add a hydrofoil near the aft end of each pontoon, preferably cantilevered inboard; such a hydrofoil will also increase the pitch stability of a boat, which may be needed if lifting hydrofoils are placed near the center of gravity. A wide variety of shapes and sizes of PLANING SWATH boats is possible, in accordance with the present invention. Design shapes alternative to those discussed above include the addition of one or more pontoon units such that each added pontoon unit contributes to both the pre-planing buoyancy and to dynamic lift when planing. A possible pontoon unit would resemble one forward support in combination with the forward half of one pontoon shown in FIG. 7 added on the centerline, either ahead or behind the boat shown in FIG. 7 to convert it into a trimaran-type boat. Alternatively, separating each pontoon shown in FIG. 7 would turn the boat into a four-pontoon configuration.

The possible fields of use are pleasure, commercial use and Governmental use. Pleasure uses include, but not limited to, cruising, fishing, camping, diving, and water skiing. Commercial uses include, but not limited to, sport and commercial fishing, diving, sight seeing, cruising, ferries, offshore crew boats, oceanic research, work boats, supply boats, underwater surveying, and patrol. Government uses include, but not limited to, the USCG, Special Forces, weapons carriers, patrol, drug interdiction, transport, and work boats.

Figure 8:
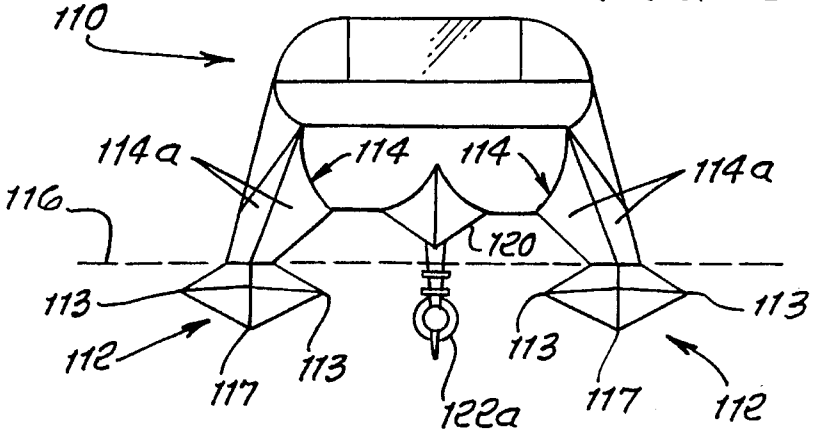
FIG. 8 is a frontal elevation, taken on lines 8—8 of FIG. 7.

FIGS. 7 and 8 show side and front views of another form of catamaran craft incorporating the invention. They are generally the same or similar to FIGS. 1 and 2, and corresponding parts are numbered the same excepting that the initial digit "1" is added. Note fore and aft supports 114 consisting solely of sponsoons 114*a*, with open space 119 therebetween. Note pontoon 112 extending ahead of support 114, and step 125 located near the center of pontoon 112 to reduce drag when planing. Element 120 may alternatively comprise a V-shaped longitudinal stiffener, and/or bow impact alleviator. Also note motor mount fairing 130. FIGS. 9 to 14 show alternative pontoon and support cross sections for any type of a PLANING SWATH boat.

In FIG. 9, the minimum lateral dimension or thickness 58 of the support 52 is spaced above the pontoons 51. Note chines 55 and strakes 56. In FIG. 10, the pontoon 61 has a V-shaped planing surface, as in FIG. 9, with chines 65 and strakes 66. Note vertical region 67 of constant pontoon width. Support portion 62 has constant width. In FIG. 11, the pontoon 71 has a V-shaped planing surface, and a convex upper surface 77, ending at chines 75 which are angled at the deadrise angle. Support 72 is all-sponson, and has no strut region. In FIG. 12 the pontoon 81 has generally V-shaped planing surfaces 81*a* and 8l*b* which are downwardly concave, and meet at cusp 81*c*. Note vertical region 87 of near-constant pontoon width. See chines 85 angled down around sixty degrees, and support strut 82.

FIG. 13 shows pontoon 101 generally like pontoon 51 in FIG. 9; however, support 102 is angled rightwardly and upwardly from its connection 108 to the pontoons. See also chines 105. In FIG. 14, the pontoon 91 has a slanted planing surface 91*a*, and hydrofoil 104 projects downwardly and inwardly toward the region under the center of the hull. See also support strut 112, upper chine 115, and keel chine 116.

Structures corresponding to elements defined in the claims are shown or described, herein.

We claim:

1. In a catamaran boat, including a propulsion system, and main hull positioned to travel above the water surface, the hull extending longitudinally forwardly, the combination comprising:

a) two pontoons, each spaced below said main hull, said pontoons extending forwardly, b) support means carried by the main hull and carrying said pontoons for allowing said pontoons to be at least mostly submerged below the water surface when said boat is loaded and at rest, and for assisting said pontoons to plane on the water surface at typical planing speeds of the boat, c) said pontoons having associated chines positioned to permit the pontoons to plane on the water, d) said support means having streamlined leading edge structure and upper sponson structure, e) said support means having lateral thickness at a longitudinal location spaced at a level above said pontoons and which is less than the maximum width of each of said pontoons at said longitudinal location, f) said upper sponson structure including two sponsons, each sponson associated with and located substantially vertically above the level of one pontoon, each sponson having lower surfaces that are relatively divergent upwardly, toward said main hull, and above the pontoon associated with that sponson, and g) each pontoon having lower planing surfaces that are relatively divergent upwardly, and upper surfaces that are relatively convergent upwardly at locations below the sponson associated with that pontoon.

2. The combination of claim 1 wherein said pontoons are symmetrical about their vertical center planes and identical, said support means being free of any substantially uniform width strut, as determined in a direction from the strut lower end to the strut upper end, above each pontoon.

3. The combination of claim 1 wherein said pontoons have assymetrical planing surfaces.

4. The combination of claim 1 wherein said pontoons have removable connections to said support structure, said connections lying inside said supports and said pontoons.

5. The combination of claim 1 wherein each said pontoon has at least one strake, said support means being free of any substantially uniform width strut, as determined in a direction from the strut lower end to the strut upper end, above each pontoon.

6. The combination of claim 1 wherein said pontoons have uppermost parts and forwardmost tips said tips positioned at levels spaced below the levels of said uppermost parts.

7. The combination of claim 1 wherein said pontoons have a boat-tailed configuration.

8. The combination of claim 1 wherein said pontoons have aft ends and taper to near-zero width at said aft ends.

9. The combination of claim 1 wherein said chines define planing surfaces, each said pontoon having at least one step on its said planing surface.

10. The combination of claim 1 wherein each pontoon has a stern and a step located near said stern, said step being sufficiently high that the lower surfaces of said pontoons are unwetted aft of said step when the pontoons plane.

11. The combination of claim 1 wherein at least one chine is laterally inclined to the horizontal within a range of fifteen degrees.

12. The combination of claim 1 wherein said pontoons have upper surfaces at least portions of which upper surface are approximately horizontal transversely.

13. The combination of claim 1 wherein said pontoons have upper surfaces that are inclined downward from a longitudinal center line at certain locations, said support means being free of any substantially uniform width strut, as determined in a direction from the strut lower end to the strut upper end, above each pontoon.

14. The combination of claim 13 wherein said upper surfaces have inverted V-shaped cross sections at certain locations.

15. The combination of claim 13 wherein said upper surfaces are curved downward instead of inclined downward.

16. The combination of claim 1 wherein each said pontoon has a vertical region of near-constant width.

17. The combination of claim 1 wherein each said pontoon has opposite end locations, a mid-point location between said end locations, and cross-sectional areas at said locations, the cross-sectional area near said mid-point location being larger than the cross-sectional area at 1/10 pontoon length inward from each of said end locations.

18. The combination of claim 1 wherein the keels of said pontoons have some rocker near the pontoon sterns.

19. The combination of claim 1 wherein said support means includes two laterally spaced supports each of which includes at least one attachment region to the associated pontoon, said support means being free of any substantially uniform width strut, as determined in a direction from the strut lower end to the strut upper end, above each pontoon.

20. The combination of claim 19 wherein each said support has at least one strake.

21. The combination of claim 19 wherein each said support has a leading edge that fairs continuously downward and rearward into the leading edge and keel of its associated pontoon.

22. The combination of claim 19 wherein each support has boat tailed configuration.

23. The combination of claim 19 wherein each support tapers rearwardly toward a relatively thin trailing edge, said support means being free of any substantially uniform width strut, as determined in a direction from the strut lower end to the strut upper end, above each pontoon.

24. The combination of claim 19 wherein each said support has a strut region of near-constant lateral thickness proximate its associated pontoon.

25. The combination of claim 19 wherein each said support has minimum thickness above its attachment to its associated pontoon at a location along pontoon length.

26. The combination of claim 19 wherein each of said supports has inclination from the vertical, said support means being free of any substantially uniform width strut, as determined in a direction from the strut lower end to the strut upper end, above each pontoon.

27. The combination of claim 1 where said propulsion system includes at least one outboard motor.

28. The combination of claim 19 where one outboard motor is placed aft of at least one of said supports.

29. The combination of claim 19 wherein said propulsion system includes at least one propulsor located between said lateral supports.

30. The combination of claim 1 wherein said boat has cross structure above said pontoons and said propulsion system includes an engine at least partially located in one of the following:

i) the cross structure ii) within a sponson iii) within a pontoon.

31. The combination of claim 19 wherein part of the structure of said main hull includes at least one longitudinal stiffener which extends at least partly below the lower surface of the main hull between said supports.

32. The combination of claim 1 including at least one lifting hydrofoil attached to at least one of the following:

i) said main hull, said supports, iii) said pontoons.

33. The combination of claim 1 including at least one hydrofoil attached to the boat or propulsor to provide stability or control.

34. The combination of claim 1 wherein said sponson structure includes a sponson extending downwardly into proximity to, and tapering toward, each pontoon, along at least part of each pontoon length.

35. The combination of claim 19 wherein said support means includes two laterally spaced fore and aft supports.

36. The combination of claim 1 wherein said propulsion system includes at least one sail.

37. The combination of claim 1 wherein said propulsion system includes at least one water jet associated with each said pontoon.

38. The combination of claim 1 wherein said propulsion system includes a fully-wetted propeller associated with each said pontoon.

39. The combination of claim 1 wherein said propulsion system includes a surface propeller associated with each said pontoon.

40. The combination of claim 1 wherein said chines define planing surfaces, and said planing surfaces having a deep-vee configuration along at least most of their length.

41. The combination of claim 40 wherein said planing surfaces are warped whereby the deadrise reduces toward the stern.

42. The combination of claim 1 wherein at least one transverse box beam of arbitrary shape is located within said main hull to help counteract torsion moments and bending moments.

43. The combination of claim 1 wherein lateral bulkheads or frames are located within at least one of:

i ) main hull ii ) support means iii) pontoons.

44. The combination of claim 1 wherein said pontoons include foam.

45. The combination of claim 1 including means to control the trim of said boat.

46. The combination of claim 9 wherein air is pumped into regions aft of at least one step.

47. The combination of claim 1 including a transverse step on the underside of the main hull near the bow.

48. The combination of claim 1 wherein at least a significant portion of the keels of said pontoons are pitched upward toward the bow relative to the design at-rest water line.

49. The combination of claim 1 wherein the water line at rest when fully loaded is in the vicinity of the top of said pontoons.

50. The combination of claim 1 wherein said pontoons extend ahead of the forwardmost attachment points to said support means.

51. The combination of claim 1 wherein said boat is statically stable in pitch and roll when at rest and loaded to any of the various possible operational water lines.

52. The combination of claim 1 with at least one pontoon unit added to said main hull which provides said boat with additional buoyancy when at rest and with additional dynamic lift when planing.

53. The combination of claim 1 wherein said supports consist solely of said sponson structure.

54. The combination of claim 1 wherein one of said sponson lower surfaces that are upwardly relatively divergent is closer to the center of the hull than the other of said sponson lower surfaces, and one of said pontoon lower surfaces that are upwardly relatively divergent is closer to the center of the hull than the other of said pontoon lower surfaces, said one sponson lower surface located vertically above said one pontoon lower surface.

55. The combination of claim 54 wherein said other of the sponson lower surfaces is located vertically above said other of the pontoon lower surfaces.

56. The combination of claim 55 wherein one of the pontoon upper convergent surfaces is located vertically between said one sponson lower surface and said one pontoon lower surface, and wherein the other of the pontoon upper convergent surfaces is located vertically between said other sponson lower surface and said other of the pontoon lower surfaces.

57. The combination of claim 1 wherein the majority of chines are located to be submerged when the boat is at rest and fully loaded.

58. The combination of claim 1 wherein the local minimum width of the support means is less than the local maximum width of the associated pontoon over the major length of the pontoon.

59. The combination of claim 1 wherein each pontoon has overall horizontal width greater than its overall vertical height.

* * * * *